US005768852A

United States Patent [19]

Terminella et al.

[11] Patent Number: 5,768,852

[45] **Date of Patent: *Jun. 23, 1998**

[54] VERTICAL FORM, FILL AND SEAL MACHINE, COMPONENTS AND METHOD FOR MAKING RECLOSABLE BAGS

[75] Inventors: Emanuele Terminella; Frank Terminella; Joseph Terminella, all of Fayetteville, Ark.

[73] Assignee: Pacmac, Inc., Fayetteville, Ark.

[ * ] Notice: The term of this patent shall not extend beyond the expiration date of Pat. No. 5,400,565.

[21] Appl. No.: 628,966

[22] Filed: Apr. 4, 1996

Related U.S. Application Data

[63] Continuation-in-part of Ser. No. 355,933, Dec. 14, 1994, Pat. No. 5,505,037, which is a continuation of Ser. No. 153,273, Nov. 16, 1993, abandoned, which is a continuation of Ser. No. 905,903, Jun. 29, 1992, abandoned.

[51] Int. Cl.[6] ..... B65B 9/20

[52] U.S. Cl. ..... 53/133.4; 53/139.2; 53/373.6; 53/552

[58] Field of Search ..... 53/133.4, 139.2, 53/373.6, 389.4, 551, 552, 554

[56] References Cited

U.S. PATENT DOCUMENTS

| | | | |
|---|---|---|---|
| 2,113,636 | 4/1938 | Vogt | 93/3 |
| 2,611,225 | 9/1952 | Williams | 53/554 |
| 2,741,079 | 4/1956 | Rausing | 53/180 |
| 2,872,762 | 2/1959 | Dreeben | 53/28 |
| 2,950,588 | 8/1960 | Gausman | 53/51 |
| 2,953,882 | 9/1960 | Tew | 53/126 |
| 2,960,808 | 11/1960 | Pike | 53/24 |
| 3,156,160 | 11/1964 | Meyer et al. | 92/13 |
| 3,256,673 | 6/1966 | Tew et al. | 53/182 |
| 3,326,097 | 6/1967 | Lokey | 53/552 |
| 3,340,674 | 9/1967 | Hoyer | 53/551 |
| 3,488,915 | 1/1970 | Delestatius | 53/112 |
| 3,530,642 | 9/1970 | Leimert | 53/180 |
| 3,538,676 | 11/1970 | Runo et al. | 53/182 |
| 3,636,826 | 1/1972 | Bowen et al. | 93/59 R |
| 3,722,376 | 3/1973 | Wech | 93/9 |
| 3,729,359 | 4/1973 | Monsees | 156/466 |
| 3,779,836 | 12/1973 | Henry et al. | 156/466 |
| 3,807,118 | 4/1974 | Pike | 53/14 |
| 3,983,682 | 10/1976 | Scully | 53/126 |
| 4,023,327 | 5/1977 | Simmons | 53/51 |
| 4,040,237 | 8/1977 | O'Brien | 53/180 |
| 4,117,647 | 10/1978 | Rossi | 53/502 |
| 4,128,985 | 12/1978 | Simmons | 53/51 |
| 4,136,505 | 1/1979 | Putnam, Jr. et al. | 53/551 |
| 4,171,605 | 10/1979 | Putnam, Jr. et al. | 53/552 |
| 4,288,965 | 9/1981 | James | 53/451 |

(List continued on next page.)

*Primary Examiner*—Linda Johnson
*Attorney, Agent, or Firm*—Head, Johnson & Kachigian

[57] ABSTRACT

A vertical form, fill and seal machine, components and method is disclosed which makes reclosable bags having a safety seal exterior to a reclosable seal and also produces durable, substantially air-tight bags at high speed and provides for the production of different size bags and different amounts of product in the bags. The disclosed machine includes a drive and pinch roll pair for pulling plastic film off of a plastic film supply roll, a pair of film pull belts biased against the plastic film wrapped around the fill tube and driven to pull the plastic film down along the side of the fill tube, and a pair of drive rollers for pulling the zipper strip through the machine. The production of different size bags is facilitated by having the plastic film drive roll, endless film pull belts, and zipper strip drive rollers all driven by a common drive source which is operated in bag length increments. Also, to accommodate the production of different size bags, a vertically adjustable ejector paddlewheel is located at the base of the machine. Further, the vertical form, fill and seal machine, components and method of the present invention insures reliable seals along the edges of each product-filled bag by having the zipper drive rollers elongate or stretch the bag material prior to cross-sealing the bag material. Also, the ejector paddlewheel serves to support the base of the bag in a manner which reduces wrinkles in the bag material along the upper edge during cross-sealing.

41 Claims, 7 Drawing Sheets

U.S. PATENT DOCUMENTS

| | | | |
|---|---|---|---|
| 4,354,541 | 10/1982 | Tilman | 150/3 |
| 4,355,494 | 10/1982 | Tilman | 53/416 |
| 4,372,793 | 2/1983 | Herz | 156/66 |
| 4,391,079 | 7/1983 | Cherney | 53/396 |
| 4,391,081 | 7/1983 | Kovacs | 53/436 |
| 4,501,109 | 2/1985 | Monsees | 53/451 |
| 4,534,159 | 8/1985 | Kelly | 53/552 |
| 4,546,595 | 10/1985 | Cherney | 53/451 |
| 4,589,145 | 5/1986 | Van Erden et al. | 383/5 |
| 4,617,683 | 10/1986 | Christoff | 383/63 |
| 4,669,251 | 6/1987 | Inagaki | 53/385 |
| 4,691,499 | 9/1987 | Umeda et al. | 53/451 |
| 4,693,058 | 9/1987 | Kovacs | 53/552 |
| 4,709,533 | 12/1987 | Ausnit | 53/451 |
| 4,727,707 | 3/1988 | Hadden | 53/451 |
| 4,727,709 | 3/1988 | Zieke et al. | 53/551 |
| 4,745,731 | 5/1988 | Talbott et al. | 53/451 |
| 4,754,593 | 7/1988 | Ishihara et al. | 53/51 |
| 4,757,668 | 7/1988 | Klinkel et al. | 53/451 |
| 4,768,326 | 9/1988 | Kovacs | 53/373 |
| 4,790,126 | 12/1988 | Boeckmann | 53/451 |
| 4,800,707 | 1/1989 | Rabus | 53/552 |
| 4,829,745 | 5/1989 | Behr et al. | 53/451 |
| 4,829,746 | 5/1989 | Schmidt et al. | 53/451 |
| 4,840,012 | 6/1989 | Boeckmann | 53/139 |
| 4,860,522 | 8/1989 | Cherney | 53/451 |
| 4,869,048 | 9/1989 | Boeckmann | 53/451 |
| 4,872,360 | 10/1989 | Lew et al. | 74/110 |
| 4,874,257 | 10/1989 | Inagaki | 383/63 |
| 4,894,975 | 1/1990 | Ausnit | 53/412 |
| 4,945,714 | 8/1990 | Bodolay et al. | 53/139 |
| 4,974,395 | 12/1990 | McMahon | 53/551 |
| 4,986,054 | 1/1991 | McMahon | 53/451 |
| 4,999,974 | 3/1991 | Kovacs et al. | 53/434 |
| 5,014,497 | 5/1991 | McMahon | 53/451 |
| 5,054,270 | 10/1991 | McMahon | 53/552 |
| 5,055,152 | 10/1991 | Inagaki | 156/244.11 |
| 5,072,571 | 12/1991 | Boeckmann | 53/133.4 |
| 5,127,208 | 7/1992 | Custer et al. | 53/412 |
| 5,167,107 | 12/1992 | Terminella et al. | 53/551 |
| 5,185,909 | 2/1993 | Inagaki | 24/587 |
| 5,235,794 | 8/1993 | Center | 53/552 |
| 5,241,804 | 9/1993 | Tsuruta et al. | 53/504 |
| 5,255,497 | 10/1993 | Zormski et al. | 53/451 |
| 5,279,098 | 1/1994 | Fukuda | 53/451 |
| 5,369,941 | 12/1994 | Rapparini | 53/546 |
| 5,377,474 | 1/1995 | Kovacs et al. | 53/64 |
| 5,400,565 | 3/1995 | Terminella et al. | 53/133.4 |
| 5,417,035 | 5/1995 | English | 53/551 X |
| 5,505,037 | 4/1996 | Terminella et al. | 53/133.4 |
| B1 4,288,965 | 3/1985 | James | 53/451 |

VERTICAL FORM, FILL AND SEAL MACHINE, COMPONENTS AND METHOD FOR MAKING RECLOSABLE BAGS

CROSS-REFERENCE TO RELATED APPLICATIONS

This application is a continuation-in-part of allowed, U.S. patent application Ser. No. 08/355,933, filed Dec. 14, 1994, now U.S. Pat. No. 5,505,037 issued Apr. 9, 1996, which is a continuation of U.S. patent application Ser. No. 08/153,273, filed Nov. 16, 1993, now abandoned, which is a continuation of U.S. patent application Ser. No. 07/905,903, filed Jun. 29, 1992, now abandoned.

BACKGROUND OF THE INVENTION

1. Field of the Invention

The present invention relates to apparatus and methods for making reclosable bags, and, more particularly, concerns a vertical form, fill and seal machine and method for making reclosable, product-filled bags.

2. Prior Art

Vertical form, fill and seal machines for making reclosable bags have been described, for example, in U.S. Pat. Nos. 4,709,533, 4,874,257, and 4,894,975. In particular, U.S. Pat. No. 4,709,533 describes a method and apparatus for making reclosable bags having a fin seal wherein a bag forming film is fed downwardly and wrapped around a spout and the edges of the film are brought together and pressed between pressing rollers to guide the edges together so that an outer fin seal can be formed by heated sealing bars. Interlocked zipper members, each attached to a respective web, form a zipper assembly which is fed between the film layers adjacent the outer edge between the pressing rollers and the spout and the zipper webs are sealed to the inner surface of the bag film by the heated sealing bars. The thus formed and sealed tube is filled with product through the spout and cross-seals and cross-cutters complete the individual bags. The fin seal is located outwardly of the reclosable zipper so as to serve as a tamper proof seal which not only protects the contents of the bag from the ingress of foreign materials and contamination but also prevents tampering with or premature inadvertent opening of the bag.

Above-mentioned U.S. Pat. No. 4,874,257 describes a vertical form, fill and seal apparatus and bag making process wherein a U-shaped zipper tape is heat sealed to the edges of a bag forming film while the film is wrapped around a cylindrical mandrel. Similarly, above-mentioned U.S. Pat. No. 4,894,975 discloses a vertical form, fill and seal apparatus which produces reclosable bags by feeding a thin thermoplastic film about a filling tube with the edges of the film brought together and joined by a zipper strip having reclosable pressure interlocking members. The zipper strip is heat sealed to the film and includes a web between the pressure interlocking members which web provides a tamper evident juncture between the edges of the film since the web must be severed for access to the interior of the bag.

Although the above described patents provide examples of vertical form, fill and seal apparatus and methods for forming reclosable bags, there is a need for an improved vertical form, fill and seal machine and method which not only forms reclosable, product-filled bags having a safety seal exterior to the reclosable seal but also which produces durable, substantially airtight bags at high speeds and which facilitates the production of different size bags and readily accommodates the addition of different amounts of product.

SUMMARY OF THE INVENTION

In accordance with the present invention, a vertical form, fill and seal machine and method is provided which not only makes reclosable bags having a safety seal exterior to a reclosable seal but also produces durable, substantially airtight bags at high speed and provides for the production of different size bags and different amounts of product in the bags.

Generally, the vertical form, fill and seal machine and method of the present invention produces reclosable, product-filled bags by joining a reclosable zipper strip, to the edges of a plastic, bag-forming film which is wrapped around a product fill tube. The zipper strip is joined to the plastic film parallel to the longitudinal axis of the fill tube by heat sealing. Separate, product-filled bags are formed by cross-sealing, filling and severing the joined zipper strip and plastic film downstream of the fill tube.

More particularly, the vertical form, fill and seal machine of the present invention includes a drive and pinch roll pair for pulling plastic film off of a plastic film supply roll, a pair of film pull belts spring-biased against the plastic film wrapped around the fill tube and driven so as to pull the plastic film down along the side of the fill tube, and a pair of zipper strip drive rollers for pulling the zipper strip through the machine. In accordance with the present invention, the production of different size bags is facilitated by having the plastic film drive roll, endless film pull belts, and zipper strip drive rollers all driven by a common drive source which is operated in steps or pulses corresponding to bag length increments. The endless film pull belts and zipper drive rollers are operated at a slightly higher speed than the plastic film supply drive roll to provide the proper tension on the plastic film as it passes through the apparatus.

Also, to accommodate the production of different size bags, a vertically adjustable ejector paddlewheel is located at the base of the machine. Thus, in order to change from one bag size to another, one need only drive the common drive source for the plastic film supply roll, film pull belts, and zipper drive rollers for a longer or shorter increment of time, and vertically adjust the ejector paddle either up or down depending on whether the bag is larger or smaller. Such adjustments can be made very readily, and, as such, the vertical form, fill and seal machine and method of the present invention facilitates the production of different size bags.

Further, the vertical form, fill and seal machine and method of the present invention ensures for airtight seals along the edges of each reclosable, product-filled bag by having the zipper drive rollers stretch or tension the bag material prior to cross-sealing and severing the bag material transverse to the longitudinal axis of the fill tube. Also, the ejector paddlewheel serves to support the base of the bag in a manner which reduces wrinkles in the bag material along the upper edge prior to cross-sealing and severing. Hence, the tensioning of the bag material by the zipper drive rollers and the supporting of the lower edge of a product-filled length of bag material by the ejector paddlewheel serve to reduce the wrinkles and enhance the production of an airtight seal along the upper edge of the bag.

In order to accommodate high rates of bag production, for example 30–100 bags per minute, the vertical form, fill and seal machine of the present invention incorporates pressurized air cooling vents adjacent each of the heat sealing bars to cool the heat seals between the zipper strip and plastic film and the heat seals along the lower and upper edges of each bag.

In accordance with an exemplary embodiment, the vertical form, fill and seal machine of the present invention produces a reclosable, product-filled bag by drawing bag length increments of plastic film and zipper strip down along the fill tube, heat sealing the zipper strip to the plastic film wrapped around the fill tube using vertically oriented platens which are reciprocated into and out of contact with the edges of the plastic film, cooling the heat seal between the zipper strip and the plastic film using pressurized air, flattening or crushing the zipper strip at bag length increments to ensure an airtight seal is formed along the edges of the bags, stretching the bag forming plastic tube made up of the plastic film and the zipper strip heat sealed thereto transverse to the longitudinal axis of the fill tube, filling the plastic tube with product, forming first and second cross-seals in the plastic tube using reciprocating heater bars which are brought into and out of contact with the plastic material, cooling the transverse seals using pressurized air, severing the plastic material between the transverse seals, and ejecting a product-filled, reclosable bag.

The principle object of the present invention is the provision of an improved vertical form, fill and seal machine and method for forming reclosable, sealed, product-filled bags. Another object of the present invention is the provision of a machine and method for forming reclosable, product-filled bags which facilitates the production of bags of different size and which accommodates different amounts of product. A still further object of the present invention is the provision of an improved, vertical form, fill and seal machine and method for making reclosable bags which provides for a high rate of bag production.

Other objects and further scope of the applicability of the present invention will become apparent from the detailed description to follow taken in conjunction with the accompanying drawings wherein like parts are designated by like reference numerals.

DETAILED DESCRIPTION OF THE PREFERRED EMBODIMENTS

Figure 1:
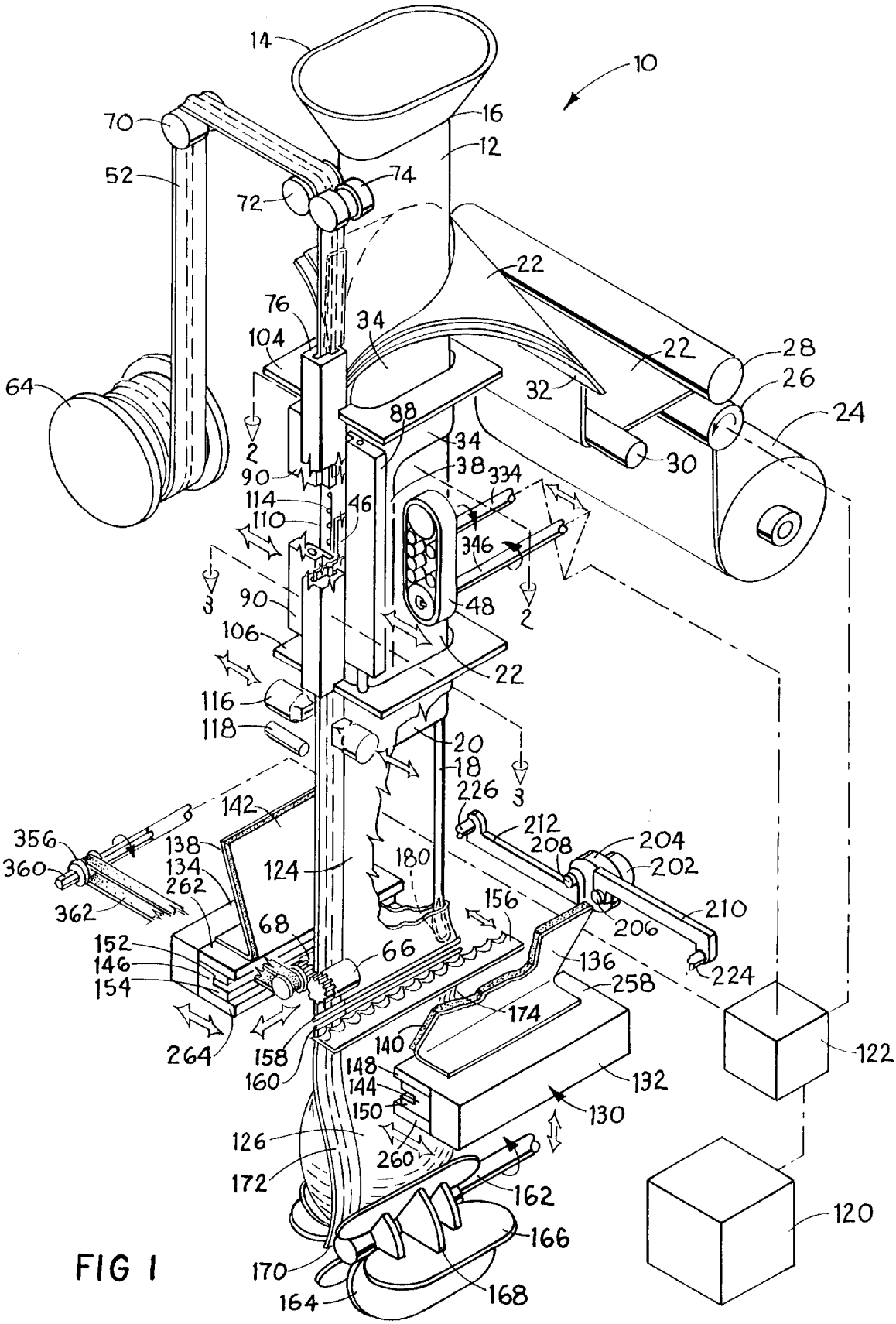
FIG. 1 is a schematic perspective view of the vertical form, fill and seal machine of the present invention.

In accordance with an exemplary embodiment of the present invention as shown in FIG. 1 of the drawings, a vertical form, fill and seal machine for making reclosable bags is generally designated by the reference numeral 10 and shown to include a vertically oriented, oval, product fill tube 12 having a product receiving funnel 14 at its upper end 16 and a depending rod or whisker 18 extending from a lower end 20. The fill tube 12, funnel 14, and whisker 18 are preferably formed of stainless steel which provides for easy cleaning and disinfection at the end of each working cycle. The funnel 14 is adapted to receive the lower end of a conventional conveyor or scale which deposits discrete bag quantities of product to the machine 10 at a selected interval during the formation of each bag.

A heat sealable, continuous, plastic film 22 is pulled from a plastic film supply roll 24 by a drive and pinch roll pair 26 and 28 oriented substantially horizontal and transverse to the longitudinal or vertical axis of the fill tube 12. Bag forming plastic film 22 passes under a directional roller 30 and is fed over a forming collar 32 which causes the plastic film 22 to wrap around the fill tube 12. Plastic film 22 passes between the oval fill tube 12 and a concentric substantially oval guide member 34 which extends from the collar 32 down along a length of the fill tube. Elongate and arcuate members 36 and 38 extend below guide 34 and serve as heat shields. Collar 32, guide member 34, and shields 36 and 38 are preferably formed of stainless steel so as to be easily cleansed and disinfected at the end of each working cycle.

Figure 2:
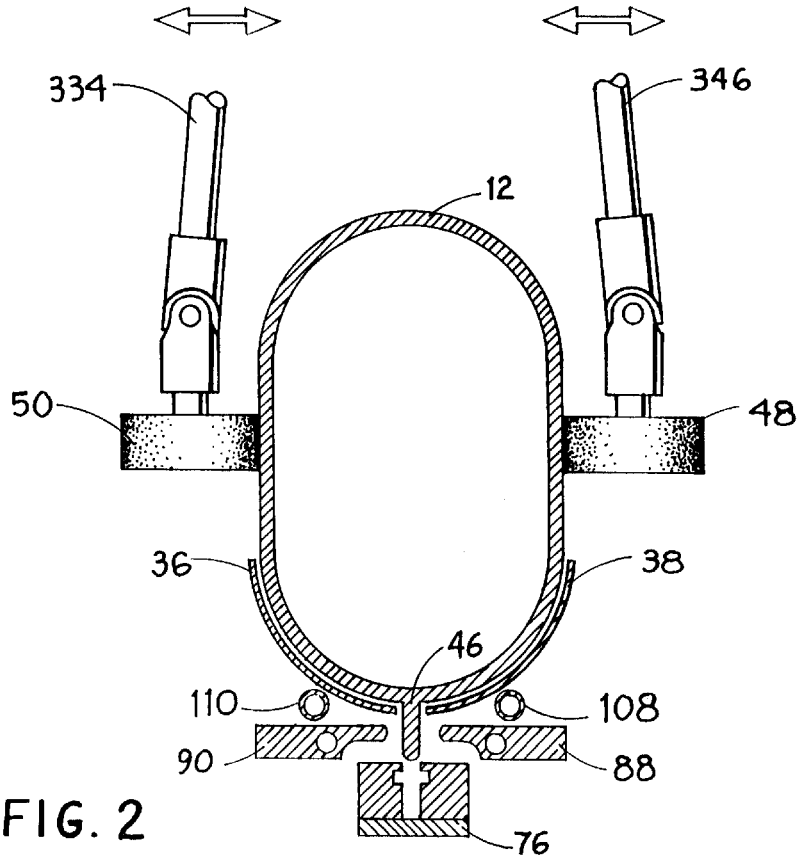
FIG. 2 is a section taken along line 2—2 in FIG. 1.
Figure 3:
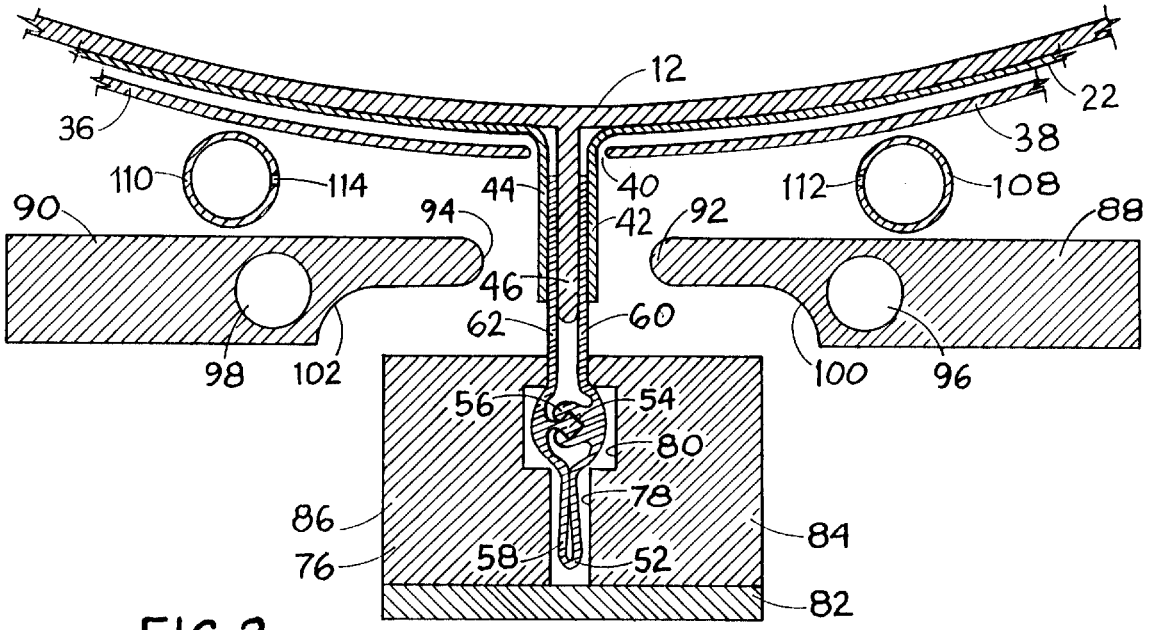
FIG. 3 is a section taken along line 3—3 in FIG. 1.

As shown in FIGS. 2 and 3 of the drawings, guide member 34 and heat shields 36 and 38 do not extend across the entire face of the fill tube 12 but have a small axial gap 40 which allows the right and left hand edges 42 and 44 of plastic film 22 to extend therefrom. The gap 40 is dimensioned so as to cooperate with a flange or divider 46 which projects from the front face of fill tube 12 and runs axially along its length. The divider 46 is preferably formed of stainless steel with a silicon coating on its exterior surface.

With reference to FIGS. 1 and 2 of the drawings, plastic film 22 is pulled down the sides of fill tube 12 by a pair of endless film pull belts 48 and 50 which are preferably spring-biased against the sides of the fill tube 12 to provide the proper drive force against the plastic film 22 and to accommodate different thicknesses of plastic film. The machine 10 is designed to accommodate heat sealable plastic films ranging in size from about six to thirty inches and in thickness from about one to ten thousandths of an inch (mils). One such plastic film is a heat sealable polyethylene, thirty inches wide, two to three mils thick, 7601PS Series produced by ARMIN Corp. It is preferred that the heat sealable webs 60 and 62 of zipper strip 52 be slightly thinner than the heat sealable plastic film 22. For example, if a three mil thick plastic film is used, then the webs of the zipper strip could be about two mil thick. A suitable zipper strip product is produced by Minigrip, Inc. of Orangeburg, N.Y.

As illustrated in FIGS. 1 and 3 of the drawings, a heat sealable plastic zipper cap strip 52 having opposing and interlocking male and female reclosable fastener elements 54 and 56 forming a continuous zipper, an interconnecting web 58, and opposing right and left hand webs 60 and 62 is pulled from a zipper strip supply roll 64 by a pair of zipper drive rollers 66 and 68. Zipper strip 52 passes up and over a grooved, directional idler roller 70 and down between a pair of grooved idler rollers 72 and 74. Idler roller 70 is located off to the left hand side of fill tube 12 while idler rollers 72 and 74 are positioned so that zipper strip 52 passes down the front of the fill tube 12 and along its midline. Right and left hand webs 60 and 62 of zipper strip 52 are separated by the divider 46 as zipper strip 52 passes down along the front of the fill tube 12. Reclosable fastener elements 54 and 56, interconnecting web 58, and a portion of the webs 60 and 62 are entrained within a guide bar 76. Guide bar 76 extends down along the length of the fill tube 12 below the grooved idler rollers 72 and 74 and opposite the divider 46 to align and guide the zipper strip 52 down along the front of the fill tube 12. Guide bar 76 includes an axial slot 78 having an enlarged portion 80 which accommodates the male and female fastener elements of zipper 54 and 56. Guide bar 76 is preferably formed of an aluminum face plate 82 and right and left hand grooved TEFLON synthetic resin polymer bars 84 and 86 attached to face plate 82 by threaded fasteners. Also, it is preferred that each of the grooved idler rollers 70, 72 and 74 be formed of TEFLON synthetic resin polymer material.

As shown in FIGS. 1–3 of the drawings, grooved idler roller pair 72 and 74, guide bar 76 and zipper drive rollers 66 and 68 are all vertically aligned on a common vertical axis parallel to the fill tube 12 and extending along its midline. In this position, the grooved idler rollers 72 and 74, guide bar 76 and zipper drive rollers 66 and 68 all cooperate with the divider 46 and heat shields 36 and 38 to feed the zipper strip 52 down along the front of the fill tube 12 with the webs 60 and 62 of zipper strip 52 located inwardly and in abutting relationship with the edges 42 and 44 of the plastic film 22 (FIG. 3). Vertically oriented heater platens 88 and 90 are positioned on opposite sides of the guide bar 76 with respective convex ends 92 and 94 which are reciprocated into and out of contact with the outer surfaces of edges 42 and 44 of plastic film 22. The heater platens 88 and 90 seal the edges 42 and 44 of plastic film 22 to the webs 60 and 62 of the zipper strip 52. Heat shields 36 and 38 serve to shield the remainder of the plastic film 22 and the fill tube 12 from the heat given off by heater platens 88 and 90. Heater platens 88 and 90 include respective heater elements 96 and 98 extending axially along the length of each heater platen. Also, each of the heater platens 88 and 90 includes cutouts 100 and 102 which provide clearance between the heater platens 88 and 90 and the guide bar 76. Guide bar 76 and shields 36 and 38 are supported by spaced horizontal bracket members 104 and 106 which also serve to support pressurized air conduits or pipes 108 and 110 each having a plurality of openings 112 and 114 for discharging air along the length of the seal between the edges 42 and 44 of plastic film 22 and webs 60 and 62 of zipper strip 52 for cooling the seal.

Located below the guide bar 76 is a zipper crushing or flattening means 116 for flattening the plastic zipper at bag length increments to ensure an airtight seal along the upper and lower edges of the bag in the area of the zipper. Zipper flattening means 116 is shown as an ultrasonic device, but it is contemplated that a pair of opposing heated bars which are reciprocated into and out of contact with the zipper strip 52 may also be used. Located downstream of the zipper crushing means 116 is an optical sensor 118 for sensing marks on the plastic film 22 and/or zipper strip 52 which indicate the bag length increments of material. For example, black marks may be located near the edges of the plastic film 22 and used not only to provide an indication of bag length increments but also proper registration of the edges 42 and 44 of the plastic film 22 relative to one another. Signals or information from the optical sensor 118 are fed to a computer control system 120 which provides control signals for driving a common drive source 122 which drives simultaneously the plastic film drive roll 26, endless film pull belts 48 and 50, and zipper drive rollers 66 and 68. In this manner, the plastic film 22 and zipper strip 52 are fed through the machine 10 in bag length increments. Hence, computer control system 120 receives input from optical sensor 118 so as to automatically adjust the duration of the drive pulse sent to common drive source 122 to accommodate for the production of different length bags. It is contemplated that computer control system 120 can provide for operator input to adjust the drive signal to drive means 122 and to override the output of optical sensor 118.

Figure 4:
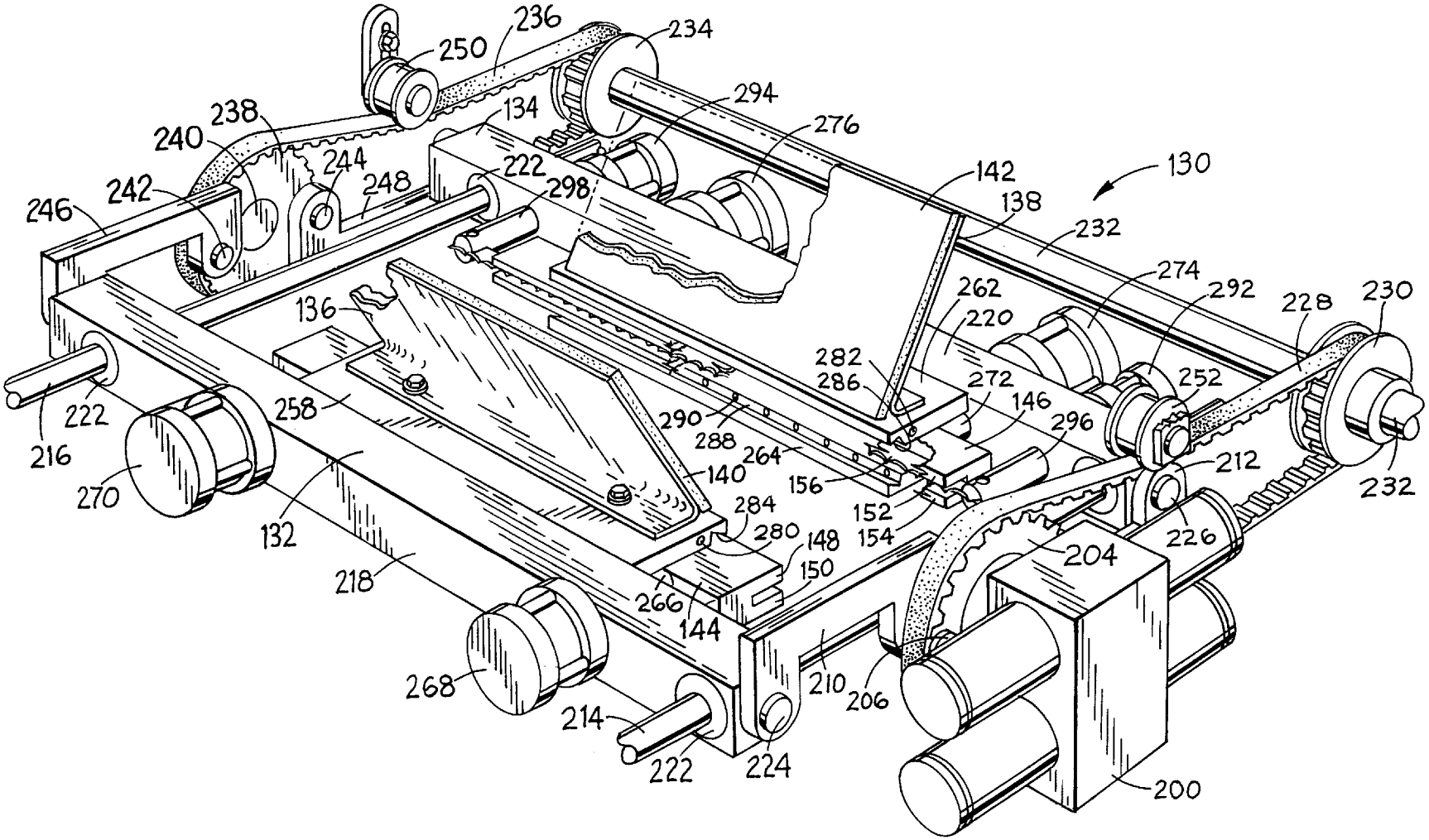
FIG. 4 is an enlarged, more detailed perspective view of the horizontal sealing and severing apparatus of FIG. 1.

As illustrated in FIGS. 1 and 4 of the drawings, as the plastic film 22 and the zipper strip 52 are joined together by heat sealing the edges of the plastic film to the webs of the zipper strip there is formed a plastic tube 124 which is sealed along its lower edge by a first horizontal or transverse seal, filled with product, sealed along its upper edge by a second horizontal or transverse seal, and, lastly, severed from the upstream portion of tube 124 to form a separate, product-filled, reclosable bag 126. This cross-sealing and severing of plastic tube 124 is accomplished by a pinch seal assembly located downstream of the zipper drive rollers 66 and 68 and whisker 18. Pinch seal assembly 130 includes a pair of opposing jaw members or clamping elements 132 and 134 which are reciprocated in a substantially horizontal plane into and out of contact with the tube 124. Jaw members or clamping jaws 132 and 134 support respective angled product stagers 136 and 138, each having padded inner surfaces 140 and 142. Supported for reciprocation relative to the jaw members are C-shaped heater elements or bars 144 and 146 each having respective upper and lower heating surfaces 148 and 150 and 152 and 154 for forming respective first and second horizontal seals 158 and 160 across the tube 124. A knife or cutting blade 156 is located within the opening in either heater element 144 or 146 and is reciprocated in order to sever the tube 124 between the first and second horizontal seals 158 and 160.

With reference again to FIG. 1 of the drawings, downstream of the pinch seal assembly 130 is an ejector apparatus 162 positioned to support the lower end of product-filled bags 126 and driven in a stepped rotary fashion so as to eject each bag following severing of the product-filled bag from the remainder of the tube 124. The ejector apparatus 162 includes a paddlewheel 164 which rotates about a central axis extending transverse to the fill tube 12 and which lies along the midline of the fill tube 12. Paddlewheel 164 has six radially extending paddles 166 with an angle of 60° between each paddle. Between each of the paddles 166 are convex support surfaces 168 which support the base of each bag in a particular fashion causing the sides of the bag to bulge outwardly and, thereby, facilitate the formation of an airtight seal along the upper edge of each bag. The central convex support surface is defined by three axially spaced circular elements 168 each being bisected by the paddles 166 and with the central circular element 168 having a larger diameter than the other two. The vertical position of ejector wheel 164 is adjustable so to accommodate the production of different size bags and to provide for adjustments in height necessary to accommodate differing amounts of product in bags of the same size. Ejector apparatus 162 is designed to cooperate with an adjacent roller conveyor (not shown) which may feed finished, product-filled, reclosable bags to an automatic case packer or other similar packaging apparatus. The completed product-filled reclosable bag 126 has a lower edge 170, an upper edge 160, a reclosable, sealed top 172, and a base 174.

In accordance with one example of the present invention, the fill tube 12 is an oval five inches wide and eight inches long and has a length of thirty-six inches. This fill tube is used with a twenty-four inch wide, two to three mil thick polyethylene film to produce product-filled bags 126 having a top to bottom dimension of about twelve inches and a width in the range of from about four to nineteen inches. In accordance with this particular example, the diameter of the center of the convex support surface in the paddlewheel 164 is approximately eight inches.

It is contemplated that the vertical form, fill and seal machine 10 of the present invention can alternatively produce bags having a top to bottom dimension of from about four inches to sixteen inches determined by the particular fill tube and plastic film being used. The machine 10 produces product-filled reclosable bags at high rates of from thirty to one hundred or more per minute depending on the size of the bag produced. The amount of product added to each bag may range from about zero to ten pounds.

In accordance with the present invention, an exemplary bag forming sequence is started by rotating the bag eject paddlewheel 164 through an angle of 60° so as to eject a previously formed product-filled reclosable bag 126. Next, bag length increments of plastic film 22 and zipper strip 52 are drawn down through the machine 10 by activating common drive source 122 a sufficient amount of time so as to cause drive roll 26 to pull a bag length increment of plastic film 22 from supply roll 24, cause film pull belts 48 and 50 to draw down a bag length increment of plastic film wrapped around fill tube 12, and have zipper drive rollers 66 and 68 pull a bag length increment of zipper strip 52 from supply roll 64. When the bag length increments of plastic film and zipper strip are being pulled down through the machine 10, the zipper drive rollers 66 and 68 are in their extended position whereat they are aligned vertically with the guide bar 76 and pair of grooved idler rollers 72 and 74 along a vertical axis parallel to the longitudinal axis of the fill tube 12. FIG. 1 of the drawings is somewhat schematic in that, for the sake of clarity, a portion of the plastic tube 124 has been removed in the area of the base 20 of the fill tube 12 and the depending whisker 18. Also, knife blade 156 is shown separate from the jaw members 132 and 134 when, in fact as shown in FIG. 4 of the drawings, knife blade 156 is supported within the heater member 146 of jaw member 134. Further, at the end of a bag forming cycle and the beginning of the next cycle, the tube 124 would be filled with a bag increment of product, not shown in FIG. 1 for the sake of clarity. Next, heater platens 88 and 90 are reciprocated inwardly toward the divider 46 so that heating surfaces 92 and 94 are brought into contact with edges 42 and 44 of the plastic film 22 in order to produce a heat seal between the webs 60 and 62 of zipper strip 52 and the plastic film 22. Zipper flattening means 116 is brought into contact with the zipper portion of the zipper strip 52 in order to flatten the zipper in the area where the tube 124 is to receive horizontal seals and be severed.

Figure 7:
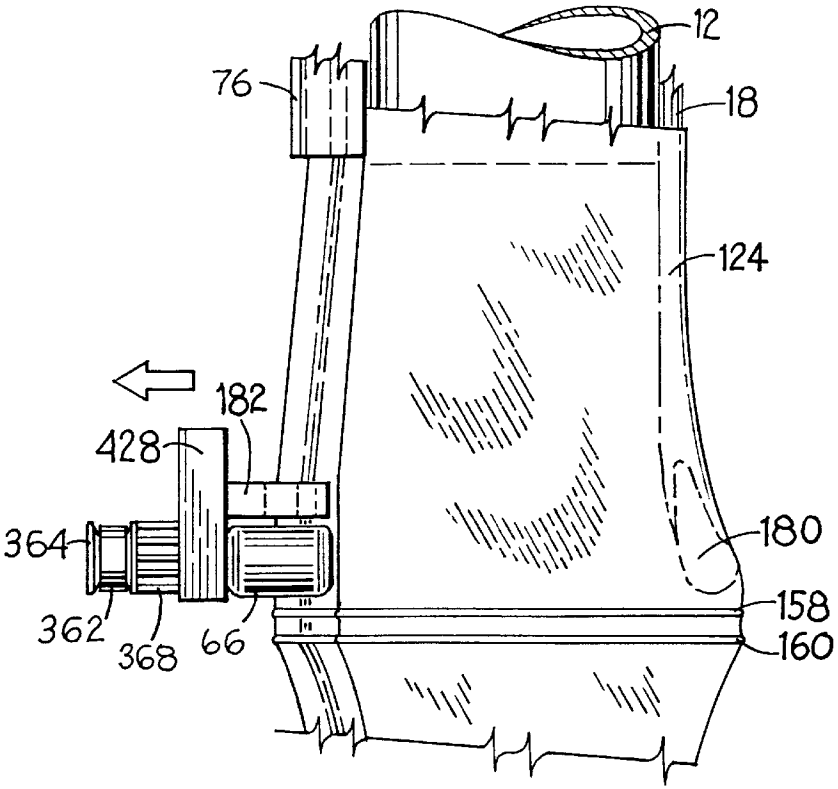
FIG. 7 is a side view representation similar to that of FIG. 6 except that the zipper drive rollers are in their retracted bag tensioning position.

Prior to clamping jaw members 132 and 134 against tube 124, zipper drive rollers 66 and 68 are retracted to stretch the tube opposite a lower flattened end 180 of the whisker 18 (FIG. 7). Zipper drive rollers 66 and 68 are kept in their retracted bag tensioning or stretching position until the end of the bag-forming cycle so that the tube 124 is stretched at its base during filling with product, the formation of the horizontal seals, and severing of the depending bag. Stretching of the tube 124 prior to sealing helps to ensure that an airtight horizontal seal is formed by eliminating wrinkles from that area of the tube 124. Also, ejector paddlewheel 164 supports the base of the previously filled and sealed tube portion so as to also reduce wrinkling in the area of the tube 124 to be horizontally sealed and severed.

While the tube 124 is being stretched or tensioned by the zipper drive rollers 66 and 68, clamping jaws 132 and 134 are brought together so that stagers 136 and 138 are brought into contact with tube 124 and allow for product to be dropped down through funnel 14 and fill tube 12 into the area of the tube 124 above the stagers 136 and 138. Surfaces 140 and 142 of the stagers are padded so as to cushion the impact of the product against the tube 124. The C-shaped heater members 144 and 146 are brought into contact with the tube 124 to form the first and second horizontal seals 158 and 160. As heater platens 88 and 90 are pulled away from the zipper strip 52 and plastic film edges 42 and 44, and heater bars 144 and 146 are reciprocated away from the plastic tube 124, the vertical and cross-seals are cooled with pressurized air. Lastly, knife 156 is reciprocated so as to slice through the tube 124 between the first and second horizontal seals 158 and 160 and, thereby, sever a completed, product-filled, reclosable bag 126 from the tube 124.

With reference again to FIG. 2 of the drawings, the machine 10 is shown without the plastic film 22 or zipper strip 52 loaded therein. It is a simple matter to load and unload the plastic film and zipper strip to and from the machine 10. For example, at the end of the work day when the machine is to be cleansed and disinfected, one need only cut the plastic film 22 upstream of the drive roll 26 and cut the plastic zipper strip 52 between the grooved rollers 70 and 72, and thereafter drive the film pull belts 48 and 50 and zipper drive rollers 66 and 68 a sufficient length of time to pull the entire remaining pieces of plastic film 22 and zipper strip 52 through the machine 10. Next, endless film pull belts 48 and 50 are reciprocated away from fill tube 12 and heater platens 88 and 90 are reciprocated away from divider 46 a sufficient distance to allow them to pass by guide bar 76 and be moved away from fill tube 12. Then, fill tube 12, guide member 34, collar 32, heat shields 36 and 38, air conduits 108 and 110, guide bar 76 and horizontal brackets 104 and 106 may be moved away from the other machine components a sufficient distance to be cleansed and sanitized using conventional high pressure hot water cleaning equipment.

Figure 6:
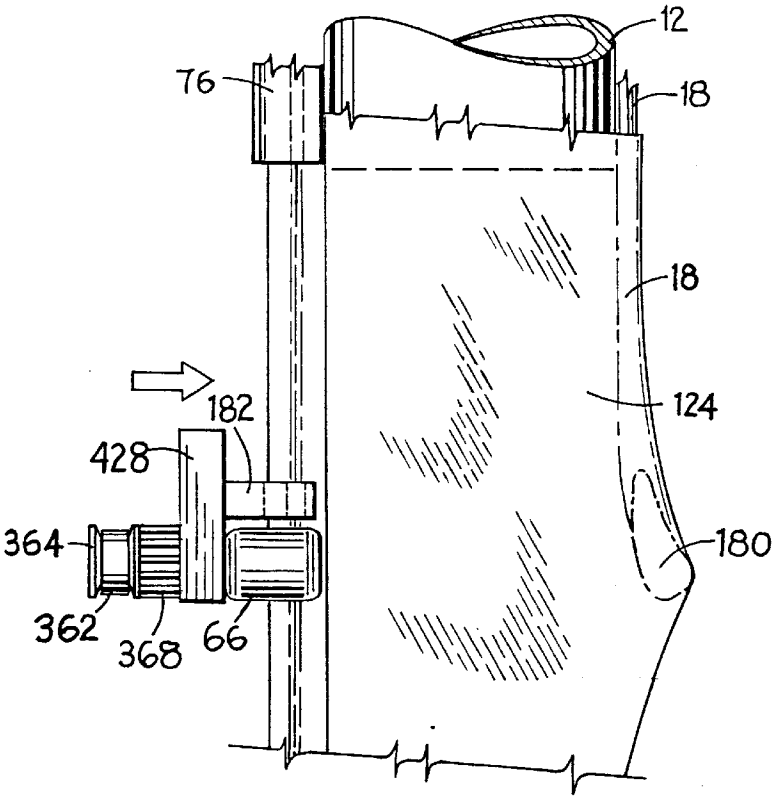
FIG. 6 is a side view illustration of the lower portion of the fill tube and the zipper drive roller assembly of the machine of FIG. 1 with the zipper drive rollers in their extended position.

Loading of the plastic film 22 and the zipper strip 52 in the machine merely requires feeding the end of the film 22 between the drive and pinch rolls 26 and 28, under directional roller 30, over collar 32 and down between guide member 34 and fill tube 12 while, at the same time, feeding zipper strip 52 over grooved roller 70, down between grooved rollers 72 and 74, down over divider 46, and into guide bar 76. Pulsing of the common drive source 122 causes drive roll 26 to pull bag length increments of plastic film 22 from the supply roll 24 and feed it to collar 32. When the plastic film 22 reaches endless film pull belts 48 and 50, the film pull belts pull the plastic film 22 down along fill tube 12 and through guide bar 76. Although it is not shown in FIG. 1, it is to be understood that a short zipper strip guide element 182 having the same cross-section as guide bar 76 can be added just above zipper drive rollers 66 and 68 so as to ensure that zipper strip 52 is fed in the correct position between the rollers 66 and 68 (FIGS. 6 and 7). Once the plastic film 22 and zipper strip 52 have been fed down between clamping jaws 132 and 134, the machine 10 is ready to produce product-filled reclosable bags.

Figure 8:
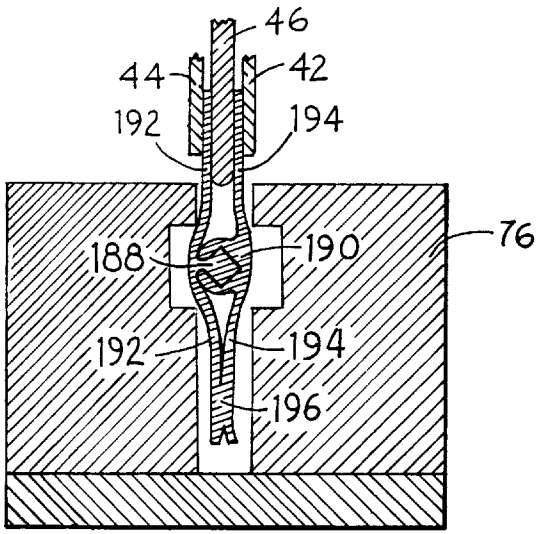
FIG. 8 is a section view similar to FIG. 3.

With reference to FIGS. 3 and 8 of the drawings, in accordance with a different embodiment of the present invention, the zipper strip 52 is replaced with a different zipper strip 186 having interlocking male and female fastener elements 188 and 190, each attached to a central area of respective plastic webs 192 and 194 with webs 192 and 194 being ultrasonically or heat sealed together at their outer edge 196. The inner edges of the webs 192 and 194 are joined to the outer edges 42 and 44 of plastic film 22 in the same fashion as the webs 60 and 62 of zipper strip 52.

With reference again to FIGS. 1 and 4 of the drawings, and in accordance with an exemplary embodiment of the present invention, the pinch seal assembly 130 is shown to include a rotary actuator 200 which is operated under computer control by computer control system 120. As illustrated, the rotary actuator 200 may comprise a two inch bore double rack pneumatic rotary actuator sold under the trademark "BIMBA PNEUTURN" by BIMBA Mfg. Corp. The rotary actuator 200 provides approximately 180° of clockwise or counterclockwise rotation with up to several hundred inch pounds of torque. Various other forms of rotary actuators including electric motor actuators and other air cylinder actuators are available and may alternatively be utilized for the rotary actuator 200. It will be noted, however, that the double rack mechanism has the advantage that the linear forces involved tend to balance due to the oppositely directed linear motion of the two racks. The pneumatic actuator 200 is provided with connection to an air pressure source, solenoid valves responsive to electronic signals from the computer control system 120, and possibly air flow control valves for controlling speed and acceleration of the mechanism.

The rotary actuator 200 is secured in a fixed position in the apparatus 10 and has an output shaft 202 on which is mounted a disc 204 serving as a two lever crank and also as a belt sprocket. The crank function of disc 204 is implemented by pins 206 and 208 serving as pivots for links 210 and 212. Each of the links 210 and 212 has an offset or dogleg to permit rotation of disc 204 through 180° without interference between links 210 and 212.

Two slide rods 214 and 216, which are fixed to the machine 10, serve as a track for the reciprocating motions of pinch seal sliders 218 and 220. Low friction bushings or bearings 222 serve to reduce the sliding friction of sliders 218 and 220 on rods 214 and 216. Sliders 218 and 220 are provided with pins 224 and 226 serving as pivot pins to connect one end of slider 218 to link 210 and one end of slider 220 to link 212. As shown in FIG. 4 of the drawings, sliders 218 and 220 are in their most distant position and will be drawn together by clockwise motion of disc 204 and will reach their most proximate position after 180° rotation of disc 204.

An endless toothed belt 228 provides a driving connection between disc 204 and a sprocket 230 mounted on a rotatable shaft 232. Shaft 232 is beyond the range of travel of slider 220 and extends to and beyond the opposite end of slider 220 where a sprocket 234 is secured thereon. Rotation of disc 204 is transmitted by belt 228, sprocket 230, shaft 232, sprocket 234, and through a belt 236 to a disc 238 which is rotatably mounted on a shaft 240. Shaft 240 is preferably coaxial with the output shaft 202 of rotary actuator 200. Pins 242 and 244 in disc 238 pivotally connect disc 238 to links 246 and 248. Links 246 and 248 are pivotally connected at their extreme ends by pins 242 and 244 to the sliders 218 and 220. Belt tensioning assemblies 250 and 252, each including grooved idler rollers, are provided for tensioning the belts 236 and 228.

Thus, it will be seen that there is provided a link and slider mechanism operated by disc 238 which is an exact counterpart of the mechanism operated by disc 204, and that disc 238 operates in unison with disc 204 thereby causing the motion of the one end of sliders 218 and 220 to conform to the motion of the other end thereof.

In accordance with the particular embodiment shown in FIG. 4 of the drawings, the jaw member 132 of pinch seal mechanism 130 is made up of slider bar 218 and upper and lower parallel plates 258 and 260 projecting inwardly toward the center of the mechanism from the inner surface of slider 218 (FIG. 1). Likewise, jaw member 134 is made up of slider bar 220 and upper and lower parallel plates 262 and 264 projecting from the inner surface of slider 220. Stagers 136 and 138 are mounted on the upper surface of plates 258 and 262 respectively. Heater bar 144 is mounted for reciprocation relative to jaw member 132 by being supported on piston rods 266 of air cylinder units 268 and 270. Air cylinder units 268 and 270 are mounted on the exterior surface of slider 218 with each having a respective cylinder rod passing through slider 218 and being connected to the rear surface of heater bar 144. Similarly, heater bar 146 is mounted for reciprocation relative to jaw member 134 by being attached to respective cylinder rods 272 of air cylinder units 274 and 276. Air cylinder units 274 and 276 are mounted on the exterior surface of slider 220 with each unit having a respective cylinder rod passing through slider 220 and being connected to the rear surface of heater bar 146.

Activation of air cylinder units 268, 270, 274, and 276 causes extension of their respective cylinders and, as such, forces the front surfaces 148 and 150 of heater bar 144 to extend beyond the front surface of the jaw member 132 and likewise causes the front surfaces 152 and 154 of heater bar 146 to extend beyond the front surface of jaw member 134. Deactivation of air cylinder units 268, 270, 274 and 276 causes retraction of their respective cylinder rods and, hence, retraction of heater bars 144 and 146 back into clamping members 132 and 134.

Each of the upper and lower plates 258 and 260 of clamping member 132 and 262 and 264 of clamping member 134 includes a plurality of small air passages for supplying pressurized air in the area of heater bars 144 and 146 so as to cool the cross-seals 158 and 160 formed in the plastic tube 124. In accordance with the particular embodiment shown, each of the plates 258, 260, 262 and 264 includes one elongate air passage extending along the length of the plate and set back a short distance from the front surface of each plate (passage 280 in plate 258 and passage 282 in plate 262), a groove running along the length of each plate parallel to the elongate air passage (groove 284 in plate 258, groove 286 in plate 262, and groove 288 in plate 264), and a plurality of cross passages 290 which provide fluid connection between the elongate air passage extending along the length of each plate and the groove in each plate (air passages 290 in groove 288 of plate 264). A source of pressurized air is connected via flexible conduits to each of the elongate air passages in each of the plates 258, 260, 262, and 264.

With reference again to FIG. 4 of the drawings, knife blade 156 is mounted for reciprocation relative to heater bar 146 and clamping member 134 via a pair of air cylinder units 292 and 294, each having a respective shaft 296 and 298 connected to opposite ends of knife blade 156. Air cylinder units 292 and 294 are mounted on the outer surface of slider 220 and have their respective shafts 296 and 298 passing through slider 220. Although knife blade 156 is shown mounted within the central cutout or groove of heater bar 146, it is contemplated that the knife blade 156 could be mounted for reciprocation with respect to either heater bar 144 or 146. Activation of air cylinder units 292 and 294 causes extension of shafts 296 and 298 which forces knife blade 156 to extend beyond the front boundary of heater bar 146 and slice through the tube 124 between upper and lower horizontal seals 158 and 160, thereby severing the product-filled reclosable bag 126 from the tube 124. Deactivation of air cylinder units 292 and 294 causes retraction of shafts 296 and 298 which pull knife blade 156 back within the confines of heater bar 146. A source of pressurized air is connected via flexible conduits to each of the air cylinder units 268, 270, 274, 276, 292, and 294 and is operated under control of the computer control system 120 so as to provide for extension and retraction of their respective shafts. Suitable air cylinder units are produced by BIMBA Mfg. Corp.

Stagers 136 and 138 serve to support the product dropped down through funnel 14, fill tube 12, and into plastic tube 124 prior to reciprocation of the clamping members 132 and 134 away from the tube 124. The padded surfaces 140 and 142 of stagers 136 and 138 cushion the dynamic force of the product as it is stopped within the plastic tube 124 after falling down through fill tube 12 SO as to prevent any damage to plastic tube 124.

The pinch seal mechanism 130 provides for rapid reciprocating motion of pinch seal sliders 218 and 220 with a mechanical linkage which produces the rapid accelerations for high speed operation while at the same time having the linkage so balanced that undesirable vibrations are almost entirely eliminated. Furthermore, the linkage, having 180° travel of the crank, causes smooth decelerations minimizing shock and further enhancing the smoothness of operation and durability of the system. The throughput of a form, fill and seal machine is often limited by the speed of operation of the pinch sealer and the apparatus of the present invention provides capability for substantially more than one hundred operations per minute with excellent reliability and minimal vibration.

Figure 5:
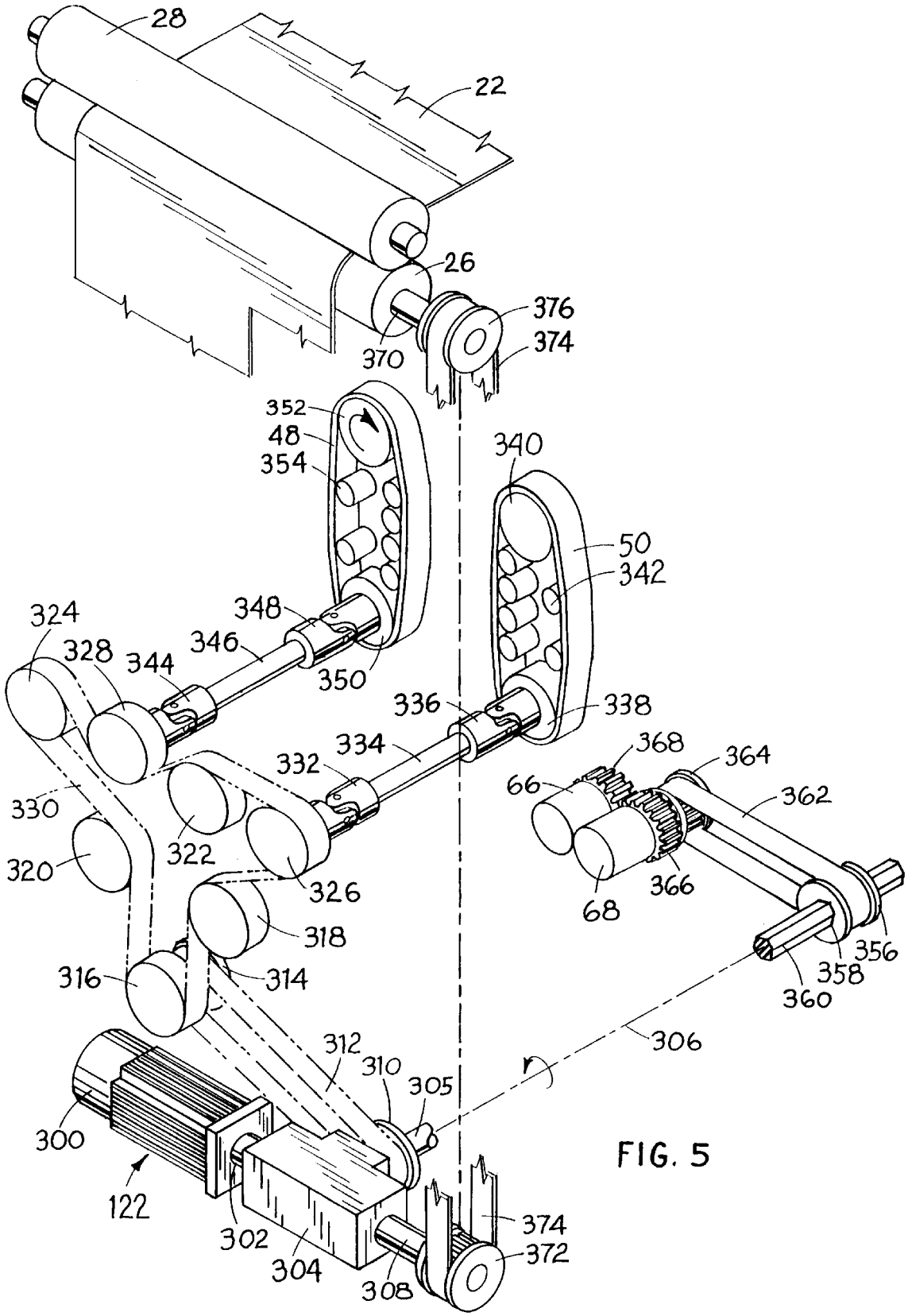
FIG. 5 is a fragmentary perspective representation of the common drive arrangement of the machine of FIG. 1.

In accordance with an exemplary embodiment of the present invention and as illustrated in FIG. 5 of the drawings, common drive source 122 for driving plastic film supply roll 26, pull down film pull belts 48 and 50, and zipper strip drive rollers 66 and 68 includes an electric servomotor 300 controlled by computer control system 120 and having an output shaft 302 serving as an input to a right angle or T-transmission 304. T-transmission 304 has a first output shaft 306 which provides drive to the pull down film pull belts 48 and 50 and zipper drive rollers 66 and 68 and a second output shaft 308 which provides drive to the plastic film drive roll 26. When servomotor 300 is activated by computer control system 120, motor output shaft 302 and transmission output shafts 306 and 308 rotate clockwise.

The drive train for the pull down film pull belts 48 and 50 includes a drive sprocket 310 mounted on shaft 306 adjacent the transmission 304 and a toothed drive belt 312 transferring drive from sprocket 310 to a drive sprocket 314. Drive sprocket 314 is mounted on a common rotation axis with another drive sprocket 316 which forms part of a belt transmission including idler sprockets 318, 320, 322, and 324, drive sprockets 326 and 328, and a toothed drive belt 330 which has teeth on both its inner and outer surfaces. The belt transmission provides a horizontally compact vertical drive arrangement which drives belts 48 and 50 at equal speed but in opposite directions. It is preferred that the rotation axis of each of the drive sprockets 316, 326, and 328 and each of the idler sprockets 318, 320, 322, and 324 is parallel to the rotation axis of transmission output shaft 306.

Drive sprocket 326 is connected to an expanding universal joint or coupling 332 which is in turn connected to a shaft 334 having another expanding universal joint 336 at its opposite end. Expanding universal joint 336 is connected to a drive pulley or roller 338 which contacts the interior surface of film pull belt 50. Film pull belt 50 is entrained around drive pulley 338, a large idler pulley 340, and a plurality of small idler pulleys 342. Similarly, drive sprocket 328 is connected to an expanding universal joint 344 which is connected to one end of a shaft 346 having another expanding universal joint 348 at its opposite end. Universal joint 348 is connected to a drive pulley 350 which provides drive to the film pull belt 48 by friction engagement with the interior surface of the belt. Film pull belt 48 is entrained around drive pulley 350, a large idler pulley 352 and a plurality of small idler pulleys 354. Expanding universal joints 332, 336, 344, and 348 are used in the drive train to the film pull belts 48 and 50 so that drive is transmitted from drive sprockets 326 and 328 to drive pulleys 338 and 350 while allowing for the film pull belts 48 and 50 to be reciprocated away from and toward the fill tube 12.

The drive train for the zipper drive rollers 66 and 68 includes a drive sprocket 356 having a hexagonal central opening 358 which receives a hexagonal end 360 on transmission output shaft 306. Drive sprocket 356 rotates along with hexagonal shaft 360, but is free to slide axially along the shaft so as to accommodate the extension and retraction of zipper drive rollers 66 and 68. A toothed drive belt 362 transfers drive from drive sprocket 356 to a drive sprocket 364 which is coaxial with and connected to another drive sprocket 366 and zipper drive roller 68. The teeth of drive sprocket 366 intermesh with the teeth of a drive sprocket 368 which is coaxial with and connected to zipper drive roller 66. Hence, as viewed from the rear of the machine, zipper drive roller 68 is rotated counterclockwise while zipper drive roller 66 is rotated clockwise. The rotational axis of drive sprockets 356, 364, 366 and 368 and of zipper drive rollers 66 and 68 are parallel to the axis of output shaft 306.

Drive is transferred from transmission output shaft 308 to a drive shaft 370 of plastic film drive roll 26 by a drive sprocket 372 mounted on the shaft 308 and a toothed drive belt 374 transferring drive from the drive sprocket 372 to a drive sprocket 376 mounted on drive roll shaft 370. The rotational axis of output shaft 308 is parallel to the rotational axis of drive roll shaft 370.

Although it is preferred that drive sprockets and toothed drive belts be used in the drive trains transferring drive from servomotor 300 to the drive roll 26, film pull belts 48 and 50, and zipper drive rollers 66 and 68, in order to provide precise relative drive ratios therebetween, it is contemplated that other drive transferring means such as sprockets and chain belts may be used. In accordance with an exemplary embodiment, drive roll 26 is formed of metal while pinch roll 28 is formed of rubber, drive pulleys 338 and 350 have at least a rubber exterior surface which provides an effective friction drive contact with the interior surface of film pull belts 48 and 50, and zipper drive rollers 66 and 68 have a rubber exterior surface which provides an effective friction grip with the zipper strip 52.

In accordance with a preferred embodiment of the present invention, the film pull belts 48 and 50 are driven at a speed five percent faster than the plastic film drive roll 26 while the zipper strip drive rollers 66 and 68 are driven at a speed ten percent greater than the speed of the plastic film drive roll 26. These ratios are selected to accommodate for stretching of the plastic material and for any slippage between the material and the film pull belts and zipper drive rollers. It is contemplated that other drive ratios may be chosen depending on the particular plastic film and zipper strip material being used. The drive ratios can be changed by changing the radii of drive sprockets used in the different drive trains.

Figure 9:
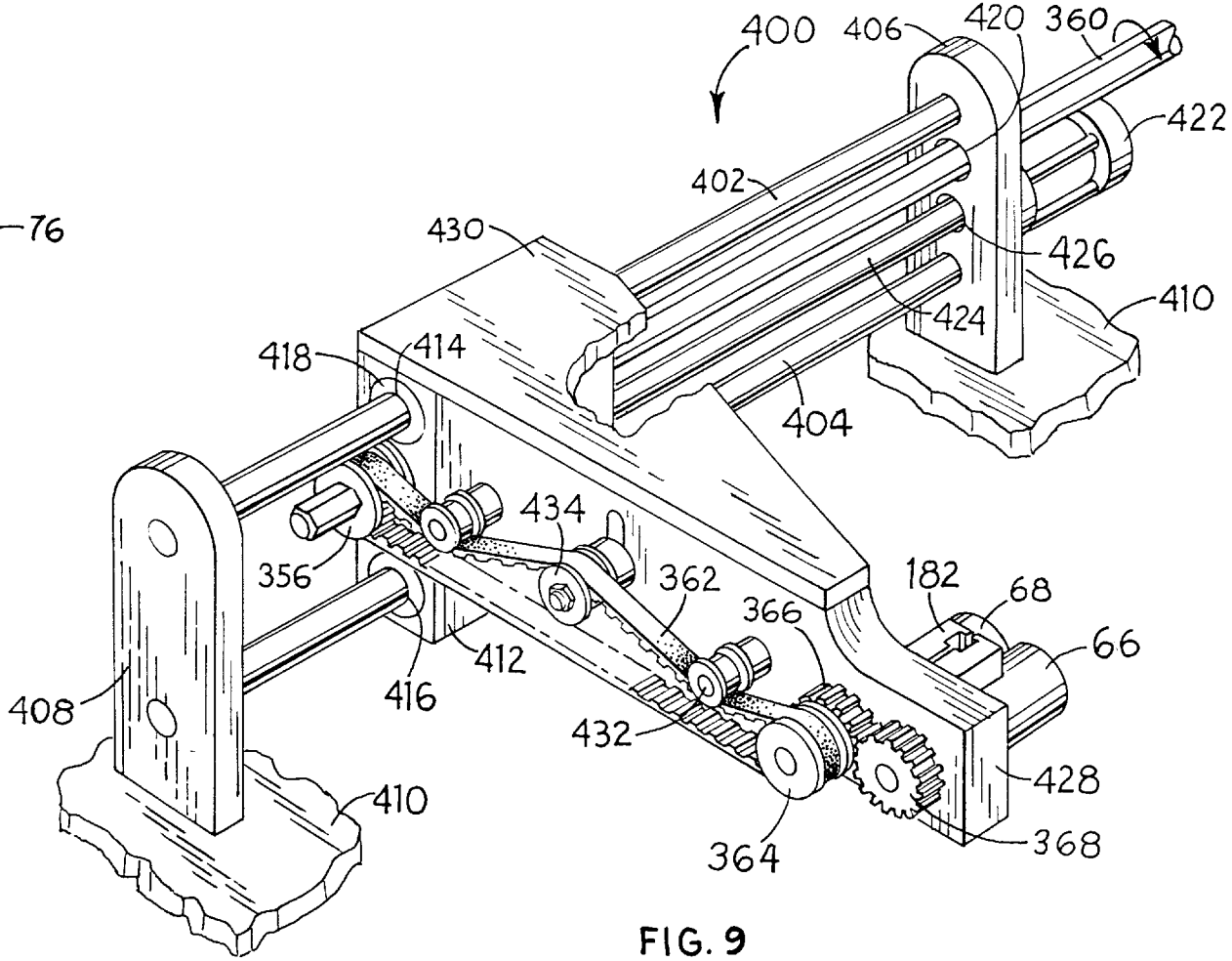
FIG. 9 is a perspective view of the zipper drive roller support and reciprocation assembly.

In accordance with an exemplary embodiment of the present invention and as represented in FIGS. 6, 7, and 9 of the drawings, zipper drive rollers 66 and 68 are retracted to a tube elongating or tensioning position (FIG. 7) prior to and during formation of cross-seals 158 and 160, filling of the tube 124 with product, and severing the tube between the cross-seals so as to form a separate, product-filled reclosable bag 126. Zipper strip drive rollers 66 and 68 are returned to their extended position (FIG. 6) vertically aligned with guide bar 76 at the start of the next bag-forming cycle.

With particular reference to FIG. 9 of the drawings, a zipper drive roller supporting and reciprocating assembly is generally designated by the reference numeral 400 and shown to include a pair of upper and lower slide rods 402 and 404 mounted transverse to the fill tube 12 and fixed with respect to the machine 10 by end brackets 406 and 408, each of which is fixed to a floor 410 of the vertical form, fill and seal machine 10. A vertical slide bar 412 includes upper and lower parallel cylindrical openings 414 and 416 for receiving slide rods 402 and 404. Each of the openings includes a friction-reducing bushing 418 which allows slide bar 412 to move freely along slide rods 402 and 404. Slide bar 412 also includes another cylindrical opening extending therethrough and parallel to the openings 414 and 416 for accommodating the hexagonal shaft 360 which passes through slide bar 412. Likewise, end bracket 406 includes a cylindrical opening 420 which provides for the passage of shaft 360 therethrough. Cylindrical opening 420 is dimensioned larger than the shaft 360 so as to allow the shaft to rotate relative to the bracket 406 without obstruction.

An air cylinder unit 422 is mounted on the exterior surface of bracket 406 and has a piston shaft 424 extending through a cylindrical opening 426 in bracket 406 and connected at its far end to the rear surface of slide bar 412. As such, extension and retraction of the shaft 424 upon activation and deactivation of the air cylinder unit 422 causes translational movement of the slide bar 412 along slide rods 402 and, thus, extension and retraction of the zipper drive rollers 66 and 68 relative to the plastic tube 124.

Zipper drive rollers 66 and 68 are mounted in a cantilever fashion by being supported on an elongate member 428 which is fixed to a side surface of the slide bar 412 and extends perpendicular therefrom. A generally triangular upper plate 430 is connected to the upper surface of slide bar 412 and the upper surface of cantilever member 428 SO as to provide support and rigidity thereto. Member 428 supports a plurality of idler rollers 432 and a drive belt tensioning sprocket 434 for drive belt 362. As mentioned above with respect to FIG. 5, drive sprocket 356 slides along hexagonal drive shaft 360 in response to movement of slide bar 412 involved in the extension and retraction of zipper drive rollers 66 and 68. Idler rollers 432 and tensioning sprocket 434 ensure that drive belt 362 remains entrained about drive sprockets 356 and 364 during translational movement of drive sprocket 356 along shaft 360. Air cylinder unit 422 is connected to a source of pressurized air via flexible conduit and a solenoid valve which is operated under the control of electronic control system 120 so as to activate and deactivate air cylinder unit 422 at the proper times during the bag-forming cycle.

Figure 10:
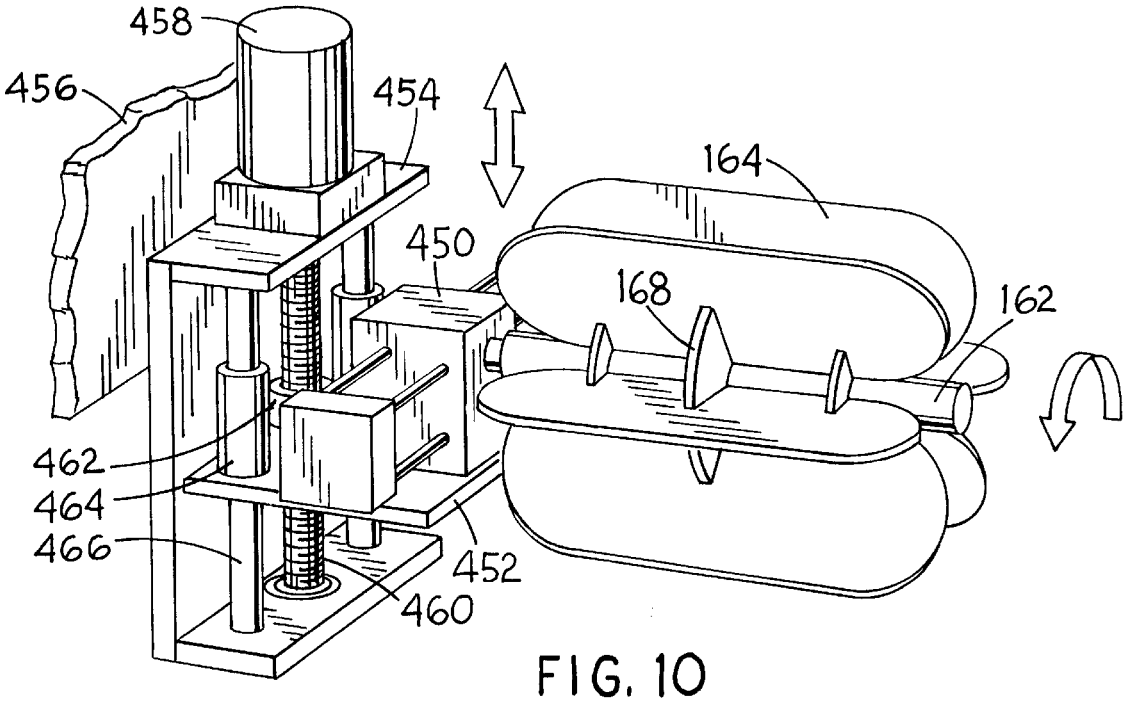
FIG. 10 is a perspective view of the ejector apparatus of FIG. 1.

In accordance with one embodiment of the present invention as shown in FIG. 10 of the drawings, ejector apparatus 162 includes a single bore air cylinder rotary actuator 450 which provides for incremental 60° counterclockwise rotations of paddlewheel 164.

Rotary actuator 450 is mounted on a base plate 452 which is suspended from an upper plate 454 fixed to the rear or back surface 456 of machine 10. Mounted atop the upper plate 454 is a small electric motor 458 having a threaded output shaft 460 which mates with an internally threaded cylindrical member 462 fixed to base plate 452. Rotation of threaded shaft 460 in one direction causes base plate 452 to be raised and in the other direction causes base plate 452 to be lowered. As such, activation of motor 458 in one direction raises ejector paddlewheel 164 while activation of motor 458 in the other direction lowers paddlewheel 164 relative to the pinch seal mechanism 130 of machine 10. Mounted to the right and left of output shaft 460 and threaded receiver 462 are stabilizer units 464 and 466 which ensure that base plate 452 remains horizontal relative to the machine 10. A source of pressurized air is connected to rotary actuator 450 by flexible conduits.

Figure 11:
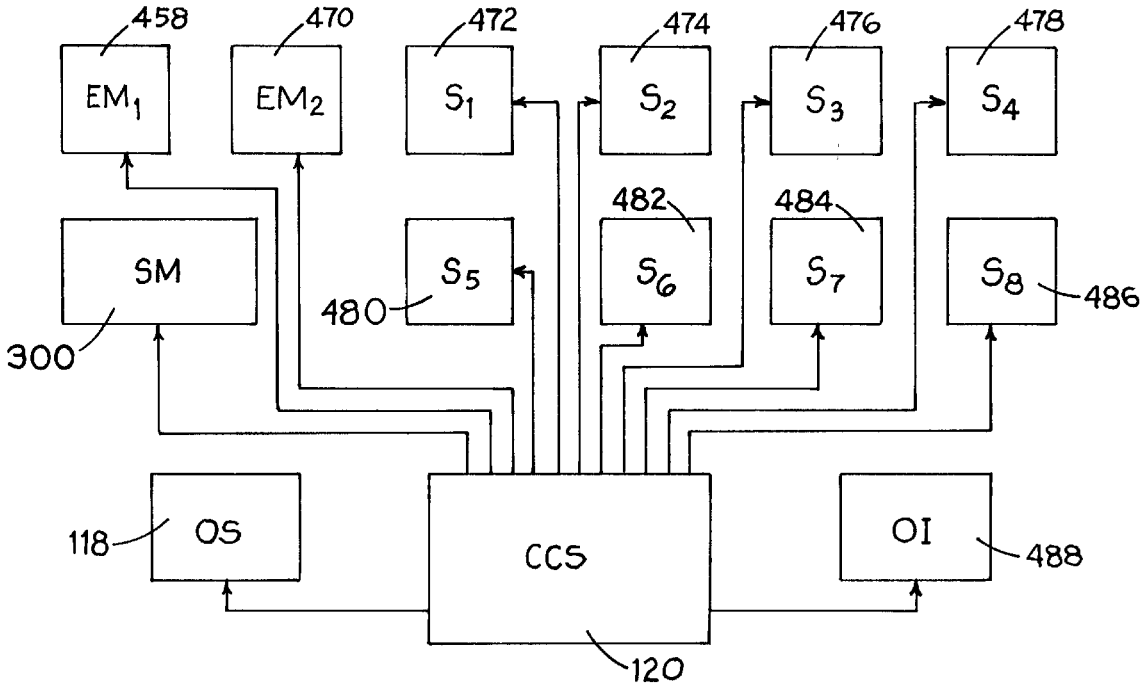
FIG. 11 is a schematic block diagram of the control system for the machine of FIG. 1.

In accordance with an exemplary embodiment of the present invention as illustrated in FIG. 11 of the drawings, the vertical form, fill and seal machine 10 includes three electric motors, electric servomotor 300, a small bi-directional motor 458, and another small bi-directional electric motor 470 for positioning the plastic film supply roll 24 along its rotational axis so as to center the plastic film with respect to the fill tube 12 and the drive and pinch roll pair 26 and 28. Electric motors 300, 458, and 470 are controlled by computer control system 120. The rest of the actuators in the machine 10 are pneumatic, that is operated by a conventional industrial source of pressurized air which is controlled through eight solenoid valves 472–486 which are themselves controlled by computer control system 120. The eight solenoid valves 472–486 control the flow of pressurized air to the respective pneumatic units which are used to reciprocate the following eight components: heater platens 88 and 90, film pull belts 48 and 50, zipper weld means 116, zipper drive rollers 66 and 68, jaw members 132 and 134, heater bars 144 and 146, knife 156, and ejector paddle 164. Computer control system 120 receives operator input via operator input means 488, such as a touch sensitive display screen or manually operated switches, to start and stop the machine, adjust the speed, sequence, and duration of bag producing steps, to adjust the temperature of the heater means, and to operate the electric motors.

Reciprocation of the film pull belts 48 and 50 toward and away from the fill tube 12 is accomplished using a disc, link and rotary actuator assembly similar to the disc 204, links 210 and 212, and rotary actuator 200 of the pinch seal mechanism 130. Similarly, heater platens 88 and 90 are reciprocated by disc, link, and rotary actuator assemblies. Although it is preferred that disc, link and rotary actuator assemblies are used for reciprocating the jaws 132 and 134, film pull belts 48 and 50, heater platens 88 and 90, and zipper weld means 116, it is contemplated that other means including electric motors may be used for reciprocating these items.

In accordance with one example of the present invention, a bag-forming cycle represented as starting at 0° and ending at 360° is as follows: from 1° to 15° a previously produced, product-filled reclosable bag 126 is ejected from the machine 10 by rotating ejector paddlewheel 164 counterclockwise through 60°; starting at 20° a bag-length increment of plastic film 22 and zipper strip 52 is drawn down through the machine 10 by activating common drive source 122 for a sufficient length of time so as to drive plastic film drive roll 26, pull down film pull belts 48 and 50, and zipper drive rollers 66 and 68 a sufficient length of time so as to draw a bag-length increment of plastic film and zipper strip along fill tube 12; from 110° to 360° zipper drive rollers 66 and 68 are retracted so as to stretch or tension plastic tube 124 by activating air cylinder unit 422 and extending shaft 424 thereby moving slide bar 412 away from rear bracket 406 and toward front bracket 408; from 120° to 260° heater platens 88 and 90 are reciprocated toward divider 46 so that heater surfaces 92 and 94 are brought into contact with the edges 42 and 44 of plastic film 22 to form the seal between the zipper strip webs 60 and 62 and the edges 42 and 44; from 125° to 360° jaws 132 and 134 are reciprocated toward plastic tube 124 in order to place the stagers 136 and 138 in position adjacent the tube 124 for the receipt of product, and to position the heater members 144 and 146 and the knife 156 adjacent the tube 124; from 141° to 340° the heater bars 144 and 146 are reciprocated so as to have their front surfaces 148 and 150 and 152 and 154 brought into contact with opposite sides of the plastic tube 124 to thereby form cross-seals 158 and 160; from 180° to 300° zipper weld or flattening means 116 are brought into contact with zipper strip 52 so as to crush or flatten the zipper in an area of zipper strip 52 whereat cross-seals 158 and 160 are to be made; from 220° to 260° knife blade 156 is reciprocated so as to slice through tube 124 between cross-seals 158 and 160; starting at 260° product is dropped through fill tube 12 into plastic tube 124; from 260° to 359° pressurized air is released from openings 112 and 114 in conduits 108 and 110 so as to cool the heat seal formed between the zipper strip and the plastic film; and from 300° to 359° pressurized air is released from the openings 290 and each of plates 258, 260, 262, and 264 so as to cool the cross-seals 158 and 160 in the tube 124. It is to be understood that this is an exemplary bag-forming sequence, and that the duration and sequence of events is determined by factors such as the bag-forming materials being used, the speed of operation, and the amount of product added to each bag.

Thus, it will be appreciated that, as a result of the present invention, a highly effective, improved, vertical form, fill and seal machine for producing reclosable, product-filled bags is provided by which the principal objective among others is completely fulfilled. It is contemplated, and will be apparent to those skilled in the art from the preceding description and accompanying drawings, that modifications and/or changes may be made in the illustrated embodiments without departure from the present invention. For example, the vertical form, fill and seal machine of the present invention may be used to produce product-filled bags which do not include a reclosable zipper. Accordingly, it is expressly intended that the foregoing description and accompanying drawings are illustrative of preferred embodiments only, not limiting, and that the true spirit and scope of the present invention be determined by reference to the appended claims.

Whereas, the present invention has been described in relation to the drawings attached hereto, it should be understood that other and further modifications, apart from those shown or suggested herein, may be made within the spirit and scope of this invention.

What is claimed is:

1. A common drive arrangement for a vertical, form, fill and seal apparatus of the type that includes a film drive roll, film pull belts, and zipper drive rollers and that operates in conjunction with a product supply apparatus providing product in discrete quantities to form a continuous, heat sealable plastic film and zippered cap strip into separate, product-filled, reclosable, sealed bags comprising:

an electric servo-motor having a drive output connected to a T-transmission having a first transmission output driving said zipper drive rollers and said film pull belts, and a second transmission output driving said film drive roll.

2. The common drive arrangement as recited in claim 1 wherein the first transmission output drives the zipper drive rollers by being operatively connected to a hexagonal shaft extending transverse to and spaced from a fill tube, and wherein a first drive belt pulley having a hexagonal central opening is mounted for sliding movement along at least a portion of the hexagonal shaft, a first drive belt passes over the first pulley and a second pulley operatively connected to at least one of the zipper drive rollers.

3. The common drive arrangement as recited in claim 2 wherein each of the zipper drive rollers has a set of gear teeth at one end thereof, the gear teeth of each zipper drive roller intermeshing with one another to cause the drive rollers to rotate in opposite directions.

4. The common drive arrangement as recited in claim 1 wherein the apparatus includes a vertical fill tube and said zipper drive rollers are mounted for reciprocation between first and second positions in a plane transverse to the vertical fill tube.

5. The common drive arrangement as recited in claim 1 wherein the servo-motor is activated by a computer control system to feed the plastic film and zippered cap strip in bag length increments.

6. The common drive arrangement as recited in claim 1 wherein the first transmission output drives the film pull belts by being operatively connected to a horizontally compact, vertical belt transmission.

7. The common drive arrangement as recited in claim 6 wherein the belt transmission is operatively connected to respective drive shafts which drive each of the pull belts at equal speed, but in opposite directions.

8. The common drive arrangement as recited in claim 7 wherein each of the drive shafts include an expanding universal joint at at least one end thereof.

9. The common drive arrangement as recited in claim 1 wherein the second transmission output drives the film drive roll via a first drive sprocket mounted on a second transmission output shaft, a second drive sprocket mounted on a shaft extending from one end of the film drive roll, and a toothed belt passing over both of the first and second drive sprockets.

10. The common drive arrangement as recited in claim 9 wherein the rotational axis of the second transmission output shaft is parallel to the rotational axis of the drive roll shaft.

11. In a vertical, form fill and seal apparatus, the improvement comprising:

a common drive arrangement for selectively driving a film drive roll, film pull belts, and zipper drive rollers, and including an electric servo-motor having a drive output connected to a T-transmission having a first transmission output providing drive to the zipper drive rollers by being operatively connected to a hexagonal shaft extending transverse to and spaced from a fill tube, and wherein a first drive belt pulley having a hexagonal central opening is mounted for sliding movement along at least a portion of the hexagonal shaft, a first drive belt passes over said first pulley and a second pulley operatively connected to one of said zipper drive rollers; said zipper drive rollers having a set of gear teeth at one end thereof, the gear teeth of each zipper drive roller intermeshing with one another to cause the drive rollers to rotate in opposite directions; said zipper drive rollers are mounted for reciprocation between first and second positions in a plane transverse to the vertical fill tube; said first transmission output also providing drive to film pull belts by being operatively connected to a horizontally compact, vertical belt transmission operatively connected to respective drive shafts which drive each of the pull belts at equal speed, but in opposite directions; each of said drive shafts including an expanding universal joint at at least one end thereof; and, a second transmission output driving said film drive roll via a first drive sprocket mounted on a second transmission output shaft, a second drive sprocket mounted on a shaft extending from one end of the film drive roll, and a toothed belt passing over both of the first and second drive sprockets, wherein the rotational axis of the second transmission output shaft is parallel to the rotational axis of the drive roll shaft.

12. A common drive arrangement for a vertical, form, fill and seal apparatus of the type that operates in conjunction with a product supply apparatus for providing product in discrete quantities and that forms a continuous, heat-sealable plastic film and a continuous cap strip into separate product-filled sealed bags comprising:

an electric servo-motor having a drive output connected to T-transmission having a first transmission output driving cap strip drive rollers and film pull belts and a second transmission output driving at least one film drive roller.

13. The common drive arrangement as recited in claim 12 wherein the first transmission output drives the cap strip drive rollers by being operatively connected to a hexagonal shaft extending transverse to and spaced from a fill tube, and wherein a first drive belt pulley having a hexagonal central opening is mounted for sliding movement along at least a portion of the hexagonal shaft, a first drive belt passes over the first pulley and a second pulley operatively connected to one of the drive rollers.

14. The common drive arrangement as recited in claim 13 wherein each of the cap strip drive rollers has a set of gear teeth at one end thereof, the gear teeth of each drive roller intermeshing with one another to cause the drive rollers to rotate in opposite directions.

15. The common drive arrangement as recited in claim 12 wherein the apparatus includes a vertical fill tube and said cap strip drive rollers are mounted for reciprocation between first and second positions in a plane transverse to the vertical fill tube.

16. The common drive arrangement as recited in claim 12 wherein the servo-motor is activated by a computer control system to feed the plastic film and cap strip in bag length increments.

17. The common drive arrangement as recited in claim 12 wherein the first transmission output drives the film pull belts by being operatively connected to a horizontally compact, vertical belt transmission.

18. The common drive arrangement as recited in claim 17 wherein the belt transmission is operatively connected to respective drive shafts which drive each of the pull belts at equal speed, but in opposite directions.

19. The common drive arrangement as recited in claim 18 wherein each of the drive shafts include an expanding universal joint at at least one end thereof.

20. The common drive arrangement as recited in claim 12 wherein the second transmission output drives the film drive roll via a first drive sprocket mounted on a second transmission output shaft, a second drive sprocket mounted on a shaft extending from one end of the film drive roll, and a toothed belt passing over both the first and second drive sprockets.

21. The common drive arrangement as recited in claim 20 wherein the rotational axis of the second transmission output shaft is parallel to the rotational axis of the drive roll shaft.

22. A common drive arrangement for a vertical form, fill and seal apparatus comprising an electric servo-motor having a drive output connected to a transmission having a first transmission output driving at least one zipper drive roller and at least one film pull belt, and a second transmission output driving at least one film drive roll.

23. A common drive arrangement for a vertical form, fill and seal apparatus comprising an electric servo-motor having a drive output connected to a transmission having a first transmission output driving at least one zipper drive roller and a second transmission output driving at least one film drive roll.

24. A common drive arrangement for a vertical form, fill and seal apparatus of the type that operates in conjunction with a product supply apparatus for providing product in discrete quantities and that forms a continuous, heat-sealable plastic film and a continuous zipper strip into separate product-filled sealed bags comprising an electric servo-motor having a drive output connected to a transmission having a first transmission output driving at least one zipper strip drive roller and film pull belt, and a second transmission output driving a film drive roll.

25. A common drive arrangement for a vertical form, fill and seal apparatus comprising an electric servo-motor having a drive output operatively connected to and driving at least one zipper drive roller and at least one film pull belt.

26. A zipper roller drive arrangement for a vertical form, fill and seal apparatus of the type that operates in conjunction with a product supply apparatus providing product in discrete quantities and that forms a continuous, heat-sealable plastic film and zippered cap strip into separate, product-filled, reclosable sealed bags comprising:

an electric servo-motor having a drive output operatively connected to a hexagonal shaft extending transverse to and spaced from a fill tube, a first drive belt pulley having a hexagonal central opening mounted for sliding movement along at least a portion of the hexagonal shaft, a second drive belt pulley operatively connected to one of a pair of the zipper drive rollers, a first drive belt passing over the first and second pulleys with each of the zipper drive rollers having a set of gear teeth at one end thereof, the gear teeth of each zipper drive roller intermeshing with one another to cause the drive rollers to rotate in opposite directions.

27. The zipper roller drive arrangement as recited in claim 26 wherein the zipper drive rollers are mounted for reciprocation between first and second positions in a plane transverse to the vertical fill tube.

28. The zipper roller drive arrangement as recited in claim 26 wherein the drive output of the electric servo-motor is operatively connected to the hexagonal shaft by a T-transmission having a first transmission output shaft having a hexagonal end.

29. A zipper roller drive arrangement for a vertical form, fill and seal apparatus comprising an electric servo-motor having a drive output connected to a T-transmission having a first transmission output driving a pair of zipper drive rollers by being operatively connected to a hexagonal shaft extending transverse to and spaced from a vertical fill tube; a first drive belt pulley having a hexagonal central opening mounted for sliding movement along at least a portion of said hexagonal shaft, a first drive belt passes over the first pulley and a second pulley operatively connected to one of the zipper drive rollers; and each of zipper drive rollers having a set of gear teeth at one end thereof, the gear teeth of each drive roller intermeshing with one another to cause the drive rollers to rotate in opposite directions.

30. A cap strip roller drive arrangement for a vertical form, fill and seal apparatus of the type that operates in conjunction with a product supply apparatus providing product in discrete quantities and that forms a continuous, heat-sealable plastic film and cap strip into separate, product-filled, reclosable sealed bags comprising:

an electric servo-motor having a drive output operatively connected to a hexagonal shaft extending transverse to and spaced from a fill tube, a first drive belt pulley having a hexagonal central opening mounted for sliding movement along at least a portion of the hexagonal shaft, a first drive belt passing over the first pulley and a second drive belt pulley operatively connected to one of a pair of cap strip drive rollers, each of the drive rollers having a set of gear teeth at one end thereof, the gear teeth of each drive roller intermeshing with one another to cause the drive rollers to rotate in opposite directions.

31. The cap strip roller drive arrangement as recited in claim 30 wherein the drive rollers are mounted for reciprocation between first and second positions in a plane transverse to the vertical fill tube.

32. The cap strip roller drive arrangement as recited in claim 30 wherein the drive output of the electric servo-motor is operatively connected to the hexagonal shaft by a T-transmission having a first transmission output shaft having a hexagonal end.

33. A reciprocating and rotary zipper roller drive arrangement for a vertical form, fill and seal apparatus comprising:

an electric servo-motor having a drive output operatively connected to a hexagonal shaft by a T-transmission having a first transmission output shaft having a hexagonal end extending transverse to and spaced from a vertical fill tube, a first drive belt pulley having a hexagonal central opening mounted for sliding movement along at least a portion of the hexagonal shaft, a first drive belt passing over the first pulley and a second drive belt pulley operatively connected to one of a pair zipper drive rollers, each of the drive rollers having a set of gear teeth at one end thereof, the gear teeth of each drive roller intermeshing with one another to cause the drive rollers to rotate in opposite directions, and wherein said drive rollers are mounted on a movable member for reciprocation between first and second positions in a plane transverse to the vertical fill tube.

34. A reciprocating and rotary zipper drive roller arrangement for a vertical form, fill and seal apparatus of the type that operates in conjunction with a product supply apparatus providing product in discrete quantities and that forms a continuous, heat-sealable, plastic film and zippered cap strip into separate product-filled, reclosable, sealed bags comprising:

means for rotating each of a pair of zipper drive rollers about a horizontal axis in opposite directions and at equal speeds, and means for reciprocating the zipper drive rollers as a unit in a horizontal plane.

35. The reciprocating and rotary zipper drive roller arrangement as recited in claim 34 wherein said means for rotating includes an electric servo-motor controlled by a computer control system and having an output shaft operatively connected to a hexagonal shaft extending transverse to and spaced from a fill tube, a first drive belt pulley having a hexagonal central opening mounted for sliding movement along at least a portion of the hexagonal shaft, a first drive belt passing over the first pulley and a second pulley operatively connected to one of the zipper drive rollers, each of the zipper drive rollers having a set of gear teeth at one end thereof with the gear teeth of each zipper drive roller intermeshing with one another to cause the drive rollers to rotate in opposite directions.

36. The reciprocating and rotary zipper drive roller arrangement as recited in claim 35 wherein said means for reciprocating comprises a zipper drive roller supporting and reciprocating assembly including parallel upper and lower slide rods mounted transverse to the fill tube and fixed with respect to the apparatus, a slide bar mounted for sliding movement on the slide rods, the slide bar having an opening extending therethrough for accommodating a zipper roller drive shaft, cylinder unit fixed in position relative to the apparatus and having a piston shaft connected at its far end to the slide bar, extension and retraction of the piston shaft upon activation-deactivation of the cylinder unit causes translational movement of the slide bar along the slide rods, the zipper drive rollers are mounted for rotation near one end of an elongate cantilever member having its other end attached to the slide bar, the cantilever member also supports a plurality of idler rollers for the first drive belt, the idler rollers insure that the drive belt remains entrained about the first and second drive sprockets during translational movement of the first drive sprocket along the hexagonal shaft.

37. The reciprocating and rotary zipper roller drive arrangement as recited in claim 36 wherein each of the slide rods and the cylinder unit are fixed in position to the apparatus by vertical brackets with one bracket including an opening for receiving the hexagonal shaft therethrough.

38. The reciprocating and rotary zipper roller drive arrangement as recited in claim 36 wherein said cantilever member also supports a drive belt tensioning sprocket for tensioning the drive belt and insuring that the drive belt remains entrained about the drive sprockets and idler rollers.

39. The reciprocating and rotary zipper roller drive arrangement as recited in claim 34 wherein the apparatus includes zippered cap strip feeding and guiding means having a pair of grooved idler rollers mounted adjacent an upper end of the fill tube and a grooved guide bar extending along a portion of the length of the vertical fill tube, and wherein the zipper drive rollers are mounted downstream of the vertical fill tube, and wherein the zipper drive rollers are reciprocated between first and second positions, in the first position, the grooved idler rollers, grooved guide bar, and zipper drive rollers are vertically aligned along a common vertical axis parallel to the vertical fill tube, and in the second position the zipper drive rollers are spaced away from the vertical fill tube and out of vertical alignment with the grooved idler rollers and grooved guide bar, and wherein the zipper drive rollers are located in the second position during horizontal sealing and severing of a product-filled bag and in the first position during incremental movement of the plastic film and zippered cap strip along the vertical fill tube.

40. A reciprocating and rotary cap strip drive roller arrangement for a vertical form, fill and seal apparatus of the type that operates in conjunction with a product supply apparatus providing product in discrete quantities and that forms a continuous, heat-sealable, plastic film and cap strip into a vertical plastic tube and then into separate product-filled, sealed bags comprising:

drive means including an electric servo-motor for rotating each of a pair of cap strip drive rollers about a horizontal axis in opposite directions but at equal speeds to drive the vertical plastic tube, and means for reciprocating the cap strip drive rollers as a unit in a horizontal plane to stretch the vertical plastic tube.

41. A reciprocating and rotary drive roller arrangement for a vertical form, fill and seal apparatus of the type that operates in conjunction with a product supply apparatus providing product in discrete quantities and that forms a continuous, heat-sealable, plastic film and zipper strip into separate product-filled, reclosable, sealed bags comprising:

drive means including an electric servo-motor for rotating at least one of a pair of zipper strip drive rollers about a horizontal axis, and means for reciprocating said zipper strip drive rollers as a unit in a horizontal plane.

* * * * *